US008056979B2

(12) United States Patent
McBride et al.

(10) Patent No.: US 8,056,979 B2
(45) Date of Patent: Nov. 15, 2011

(54) SUPPORTING DEVICE

(75) Inventors: Robert McBride, Springfield, MO (US); Newton W Lin, Taichung (TW); Robert McDonial, Ozark, MO (US); James Lucas, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 0 days.

(21) Appl. No.: 11/518,309

(22) Filed: Sep. 11, 2006

(65) Prior Publication Data

US 2008/0061615 A1 Mar. 13, 2008

(51) Int. Cl.
*A47C 1/00* (2006.01)

(52) U.S. Cl. ..... 297/326; 297/344.1; 297/344.18

(58) Field of Classification Search ..... 297/344.1, 297/344.18, 325, 326, 327, 328; 482/143, 482/144; 601/24

See application file for complete search history.

(56) References Cited

U.S. PATENT DOCUMENTS

| | | | | | |
|---|---|---|---|---|---|
| 25,448 | A | | 9/1859 | Smith | |
| 1,344,255 | A | | 6/1920 | Beckman et al. | |
| 2,282,109 | A | * | 5/1942 | Angell | 297/19 |
| 2,532,453 | A | | 12/1950 | James | |
| 2,652,880 | A | | 9/1953 | Gundersen | |
| 2,786,512 | A | | 3/1957 | Moyer | |
| 2,932,038 | A | | 4/1960 | Sprague | |
| 3,081,085 | A | * | 3/1963 | De Girolamo | 482/144 |
| 3,112,955 | A | | 12/1963 | Stolz | |
| 3,210,779 | A | | 10/1965 | Herbold | |
| 3,326,604 | A | * | 6/1967 | Billingham et al. | 297/328 |
| 4,072,318 | A | * | 2/1978 | Laune | 280/42 |
| 4,142,520 | A | | 3/1979 | Herbold | |
| 4,150,851 | A | * | 4/1979 | Cienfuegos | 297/215.13 |
| 4,214,790 | A | | 7/1980 | Sieber | |
| RE31,092 | E | | 11/1982 | Sieber | |
| 4,387,876 | A | * | 6/1983 | Nathan | 248/571 |
| 4,419,989 | A | | 12/1983 | Herbold | |
| 4,561,692 | A | | 12/1985 | Yestadt et al. | |
| 4,717,148 | A | | 1/1988 | Brewer | |
| 4,739,749 | A | | 4/1988 | Lindley | |
| 4,787,375 | A | | 11/1988 | Krause | |
| 4,790,599 | A | | 12/1988 | Goldman | |
| 5,031,905 | A | * | 7/1991 | Walsh | 482/112 |
| 5,131,719 | A | * | 7/1992 | Kassai | 297/344.18 |
| 5,334,123 | A | * | 8/1994 | Rutherford | 482/144 |
| 5,346,280 | A | * | 9/1994 | Deumite | 297/330 |
| 5,449,334 | A | | 9/1995 | Kingsbury | |
| 5,575,745 | A | | 11/1996 | Lin | |
| 5,718,660 | A | * | 2/1998 | Chen | 482/144 |
| 5,885,197 | A | | 3/1999 | Barton | |
| 5,984,409 | A | | 11/1999 | Eakin et al. | |
| 6,050,642 | A | | 4/2000 | Erb | |
| D432,600 | S | | 10/2000 | Szabo et al. | |
| 6,243,897 | B1 | * | 6/2001 | Sumiya | 5/610 |

(Continued)

*Primary Examiner* — Sarah B McPartlin
(74) *Attorney, Agent, or Firm* — Pillsbury Winthrop Shaw Pittman LLP

(57) ABSTRACT

An assembly for supporting a user in multiple positions relative to a surface, the assembly including a frame positioned on the surface, a support being movably coupled to the frame, a first connector extending from beneath the support and being movable with the support as the support moves relative to the frame, and a second connector positioned beneath the support. The first connector is movable relative to the second connector as the support moves relative to the frame, and the first connector is selectively secured to the second connector in different positions, each of the different positions corresponding to a different position of the support relative to the frame.

41 Claims, 8 Drawing Sheets

U.S. PATENT DOCUMENTS 6,435,611 B1 8/2002 Walter
6,464,296 B1 * 10/2002 Sumner ..... 297/326
6,679,818 B2 * 1/2004 Hsien ..... 482/144
6,811,522 B1 11/2004 McQuinn
6,855,098 B2 2/2005 Reitz et al.
6,942,296 B2 9/2005 Lingegard et al.
7,025,415 B1 * 4/2006 Wu ..... 297/119
7,361,128 B2 * 4/2008 Chen ..... 482/144

* cited by examiner

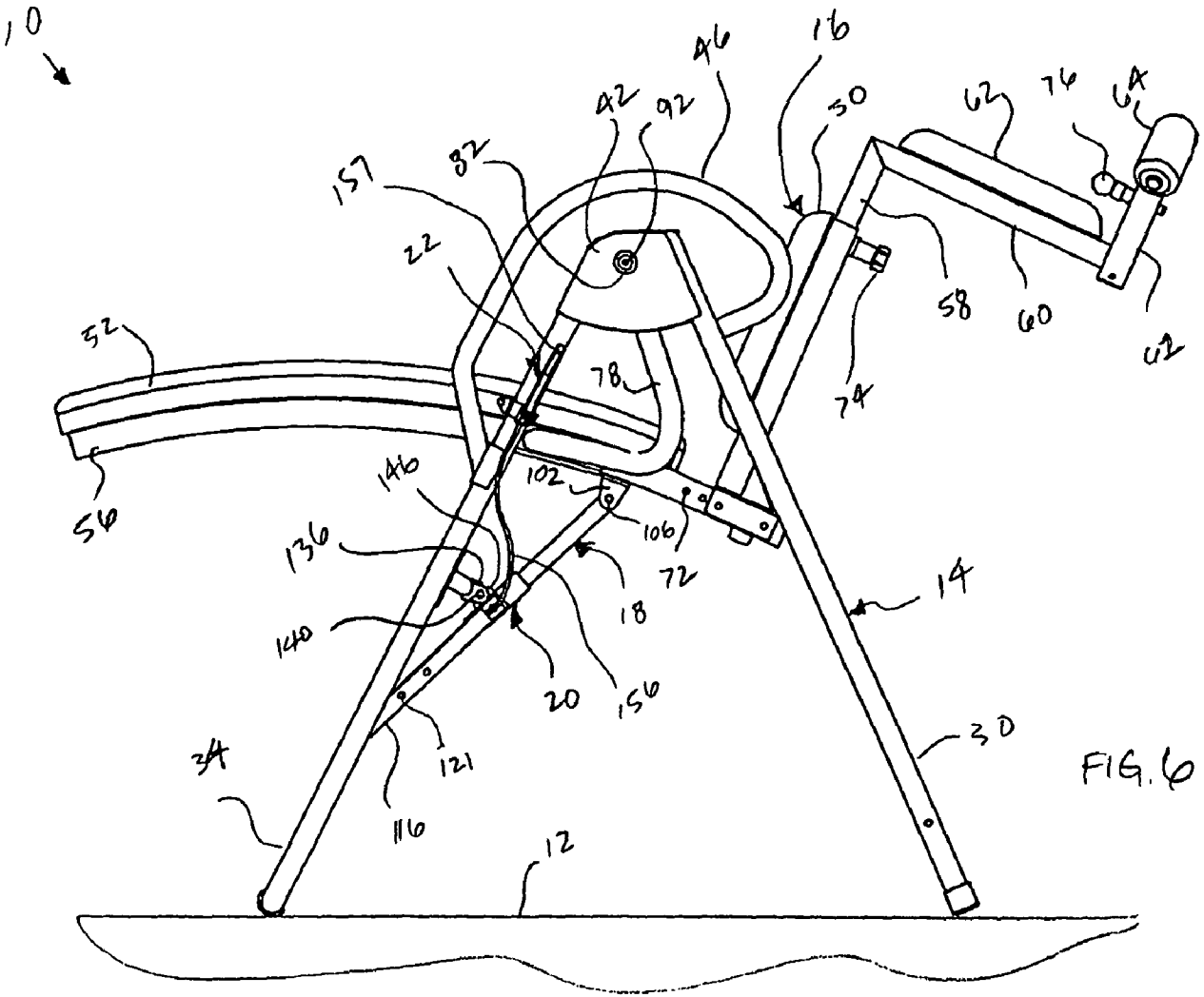
10
12
14
16
18
20
22
24
26
28
30
32
34
36
38
40
42
44
46
48
50
52
54
56
58
60
62
64
66
68
70
72
74
76
78
80
82
84
86
88
90

SUPPORTING DEVICE

FIELD OF THE INVENTION

The present invention relates to a device for supporting a user in various positions. More specifically, the present application provides illustrated embodiments of the present invention, including those relating to an inversion chair for selectively positioning a user in various positions relative to surface.

BACKGROUND

Apparatus for tilting a user relative to surface are disclosed in U.S. Pat. No. 2,932,038 to Sprague and U.S. Pat. No. 6,679,818 to Hsien, each of which is incorporated herein in its entirety by reference thereto, respectively.

SUMMARY OF THE INVENTION

One aspect of the invention relates to an assembly for supporting a user in multiple positions relative to a surface, the assembly including a frame positioned on the surface; a support being movably coupled to the frame; a first connector extending from beneath the support and being movable with the support as the support moves relative to the frame; and a second connector positioned beneath the support, the first connector being movable relative to the second connector as the support moves relative to the frame, and the first connector being selectively secured to the second connector in different positions, each of the different positions corresponding to a different position of the support relative to the frame.

Another aspect of the invention relates to an assembly for supporting a user in multiple positions relative to a surface, the assembly including a frame positioned on the surface; a support being pivotably coupled to the frame; a first connector extending from beneath the support and being movable with the support as the support moves relative to the frame; a second connector extending from the frame and positioned beneath the support; and a controller that moves a fastener, which is coupled between the first and second connectors, between a locked position that prohibits movement between the first and second connectors and between the support and the frame and an unlocked position that permits movement between the first and second connectors and between the support and the frame.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings:

FIG. 6 is an enlarged view of FIG. 2;

DESCRIPTION OF ILLUSTRATED EMBODIMENTS

Figure 1:
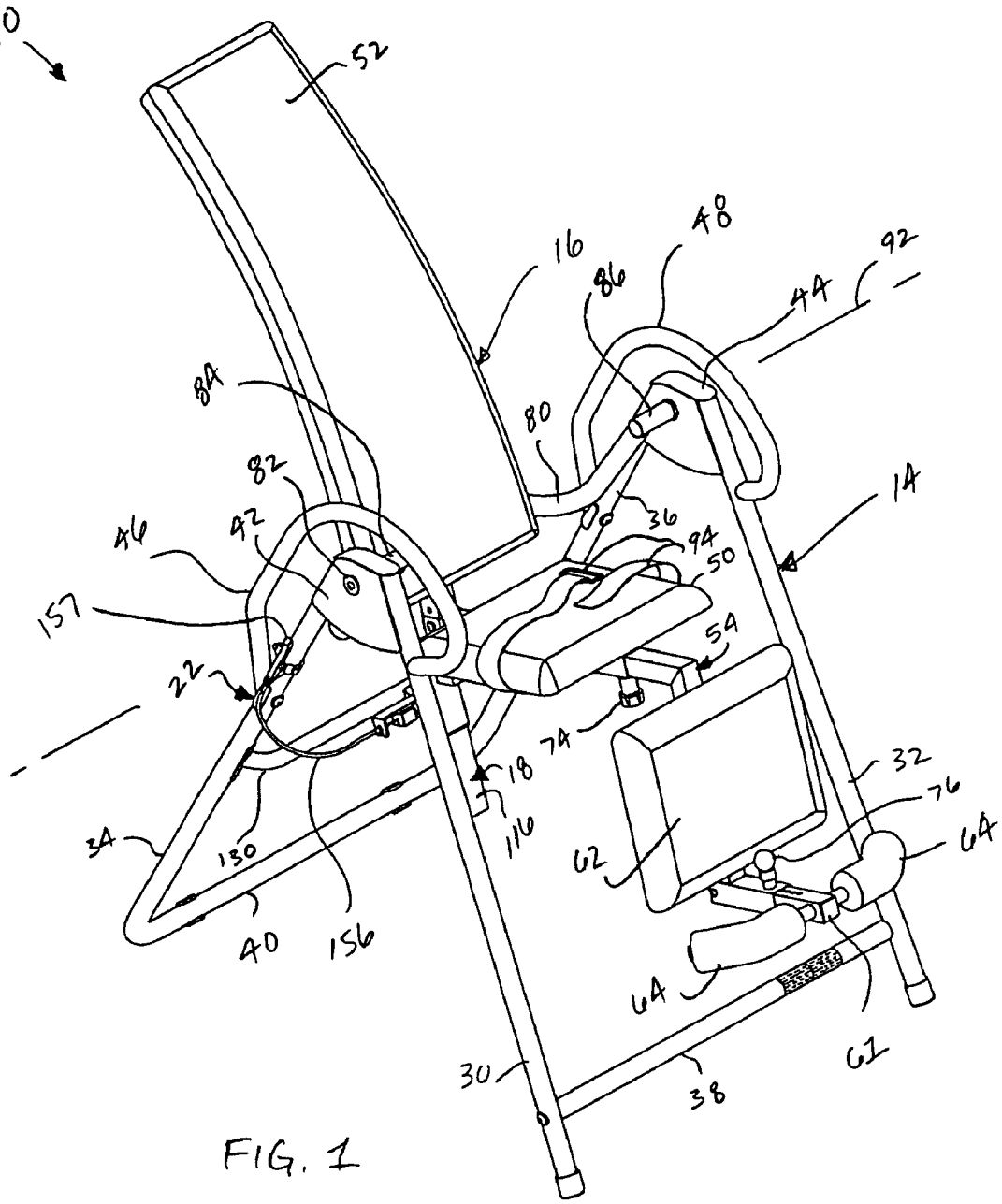
FIG. 1 illustrates a perspective view of chair in accordance with one illustrated embodiment of the present invention.

FIGS. 1-12 illustrate one, illustrated embodiment of the subject invention. In particular, the figures show a seated inversion assembly 10 for supporting a user in multiple positions relative to a surface 12. The assembly 10 includes a frame 14 positioned on the surface 12; a support 16 pivotably coupled to the frame 14; a first connector 18 extending from beneath the support 16 and being movable with the support 16 as the support 16 moves relative to the frame 14; a second connector 20 extending from the frame 14 and positioned beneath the support 16; and a controller 22 that moves a fastener 24, which is coupled between the first and second connectors 18 and 20, between a locked position that prohibits movement between the first and second connectors 18 and 20 and between the support 16 and the frame 14 and an unlocked position that permits movement between the first and second connectors 18 and 20 and between the support 16 and the frame 14. As illustrated, the assembly 10 may take the form of a chair.

The frame 14 may take various configurations but is illustrated as a multi-leg structure having front legs 30 and 32 and rear legs 34 and 36. Cross member 38 extends between front legs 30 and 32 and cross member 40 extends between rear legs 34 and 36. The illustrated frame is configured to have a generally inverted V-shaped configuration when viewed from the side and the uppermost portion of each side includes a joint 42 and 44 for pivotably connecting with the support 16. Each side of the frame 14 has a rigidly secured handrail 46 and 48 for the user to grasp while the support 16 pivots relative to the frame 14. The frame 14 is typically positioned on a flat surface 12.

The support 16 may take various forms but is illustrated as forming part of a chair, including a seat portion 50 and a back portion 52 that are interconnected by a brace 54, which includes a back brace 56, a seat brace 58, a leg brace 60, which supports a leg portion 62, and a foot brace 61, which supports a foot portion 64. In the figures, the seat portion 50, the back portion 52, the leg portion 62 and the foot portion 64 are formed so that a user can comfortably sit in the chair 10. The seat portion 50 is configured so that the user can sit on the seat portion 50. The back portion 52 is configured for receiving the user's back. The leg portion 62 is configured to receive the back of the user's legs, and the foot portion 64 is configured so that the user may position the foot portion 64 on top of the user's feet and in the front of the user's ankles. The various parts of the brace 54 may be adjustably secured to each other, as illustrated. For example, the seat brace 58 may be adjustably coupled to the back brace 56 by interlocking fasteners, such as bolts 66 (and nuts 68 and washers 70) that are selectively inserted into holes 72 in the back brace 56. Also, the brace portions may be coupled in telescoping fashion to provide additional adjustment capabilities, such as illustrated in FIG. 1, wherein the leg brace 60 is inserted into the seat brace 58 and secured by a fastener with an adjusting knob 74, and the foot brace 61 is inserted into the leg brace 60 and is also secured by a fastener with an adjusting knob 76. The back portion 52 may take various configurations. For example, it may be curved as illustrated or substantially straight.

Figure 11:
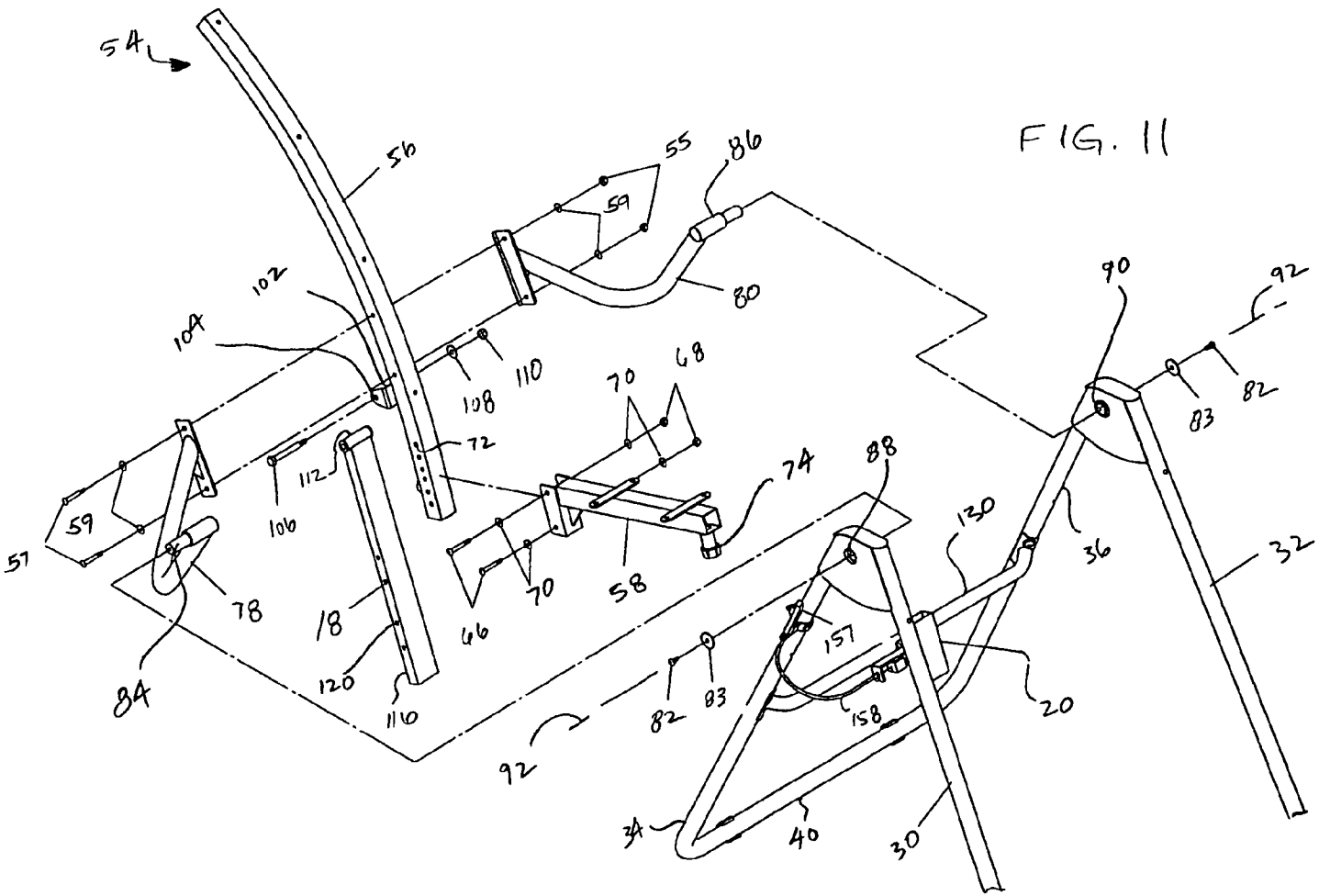
FIG. 11 is a partial, exploded view of the chair of FIG. 1.

The brace 54 is coupled to the frame 14 so that the support 16, and the user thereon, may be moved relative to the frame 14. This connection is illustrated in the figures by a pair of pivot arm 78 and 80, which extend from the back brace 56 and into the joints 42 and 44, respectively, of the frame 14. The pivot arms 78 and 80 are illustrated as being attached to the back brace 56 by respective fasteners, such as, respective nuts 55, bolts 57, and washers 59, as illustrated in FIG. 11. As shown in the figures, appropriate fasteners may attach pivot arms 78 and 80 to the joints 42 and 44. For example, respective bolts 82 and washers 83 may be used, with each bolt 82 being secured within a respective threaded opening in ends 84 and 86. The ends 84 and 86 of pivot arms 78 and 80, respectively, are shown as being cylindrical rods that are inserted into corresponding openings 88 and 90 in respective joints 42 and 44 in the frame 14. The ends 84 and 86, as illustrated, have, as their longitudinal axis, the pivot axis 92 about which they pivot and around which the support 16 likewise pivots with respect to the frame 14. The support 16 is also illustrated as having a seat belt 94 to secure the user while the support 16 pivots.

The first and second connectors 18 and 20 and the selective coupling between the two connectors 18 and 20 may take various configurations. As best seen in FIG. 11, the illustrated coupling between the first and second connectors 18 and 20 may be configured with the first connector 18 being rod-shaped, with holes extending through the connector 18. The connector 18 is pivotably attached to the back brace 56, which has a generally U-shaped bracket 102 that may be rigidly attached to the back brace 56 in an appropriate manner, such as by welding or with a fastener. The bracket 102 has openings 104 for receiving a fastener 106, which is illustrated as a bolt with a corresponding washer 108 and nut 110. The connector 18 has a pivot end 112 with an opening. The pivot end 112 corresponds in shape to fit within the bracket 102 so that the fastener 106 may be inserted within one opening 104 of the bracket 102, within the opening 114, and within the other opening 104 of the bracket 102, and pivotably secure the pivot end 112 to the bracket 102. The pivot end 112 may include a rounded surface or be otherwise configured to facilitate pivoting of the connector 18 around the fastener 106, which acts as a pivot pin for the connector 18 relative to its connection with the back brace 56. Of course, if desired, appropriate friction reducing elements, such as bearings 115 may be inserted into the opening 114 to control the level of friction between the various elements as the connector 18 pivots with respect to the back brace 56.

At its connecting end 116, the illustrated embodiment is shown as having a series of holes 118-121 extending through the connector 18. Although any desired number of holes may extend through the connector 18, the illustrated connector 18 shows four holes 118-121. If multiple holes are used, any appropriate spacing between holes may be employed. For example, the holes may be evenly spaced. In the illustrated connector 18, the holes 118-121 are unevenly spaced. The holes 118-121 may be spaced to correspond to predetermined positions of the support 16. In other words, the holes 118-121 may be spaced so a particular hole, or each hole, if selected for coupling as set forth below, corresponds to a predetermined position of the user on the support 16, relative to the surface 12. The connector 18 may be formed as a hollow rod and may be closed at the connecting end 116 by a cap 124 that frictionally fits within the connector 18 at the open end of connecting end 116.

Figure 9:
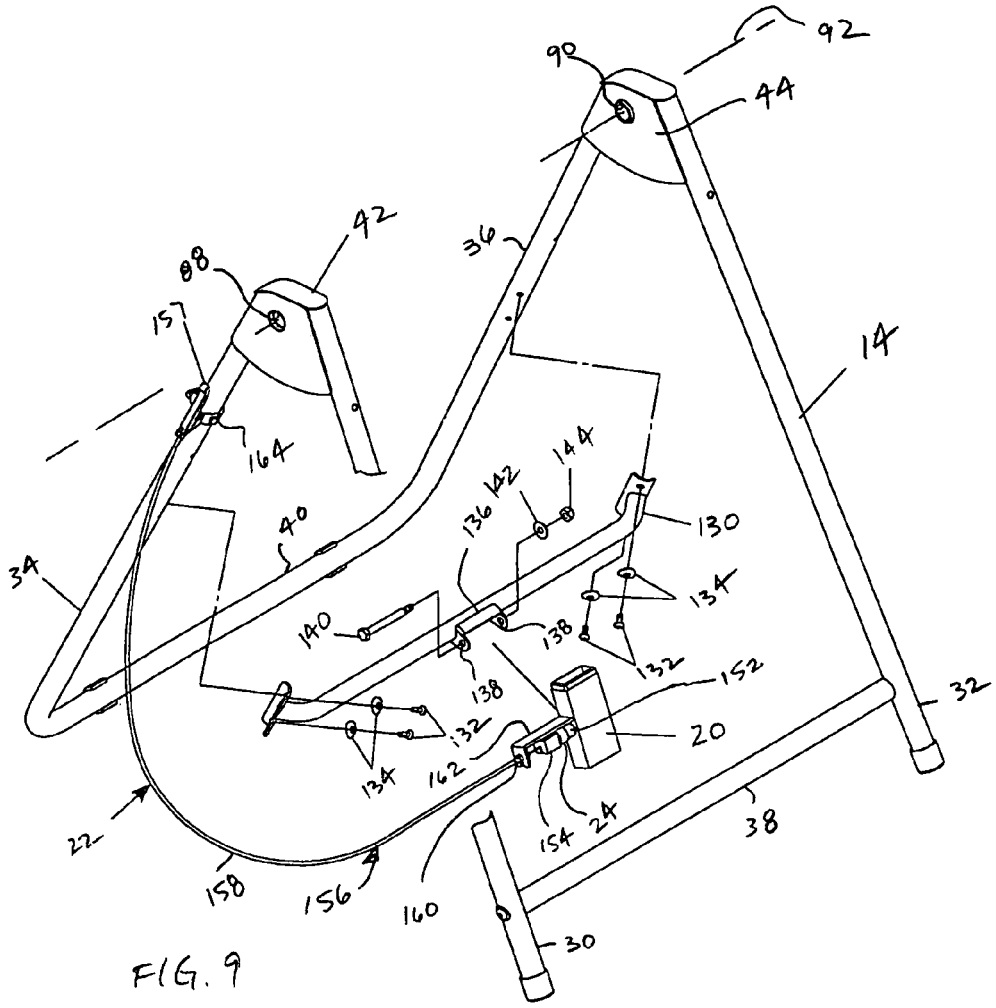
FIG. 9 is a partial, exploded view of the chair of FIG. 1.

As best seen in FIG. 9, the illustrated coupling between the first and second connectors 18 and 20 may be configured with the second connector 20 being shaped as a female connector to receive the connector 18. Since the illustrated second connector 18 has a generally rectangular cross-section, the illustrated connector 20 has a slightly larger, generally rectangular, hollow cross-section to receive the connector 18. The second connector 20 is pivotably attached to the frame 14 via a cross brace 130 that is rigidly secured to the rear legs 34, 36 of the frame 14 in an appropriate manner, such as by fasteners 132 with washers 134. The cross brace 130 has a generally U-shaped bracket 136 that may be rigidly attached to the cross brace 130 in an appropriate manner, such as by welding or with a fastener. The bracket 136 is similar to bracket 102 and has openings 138 for receiving fastener 140, which is illustrated as a bolt with a corresponding washer 142 and nut 144.

Figure 7:
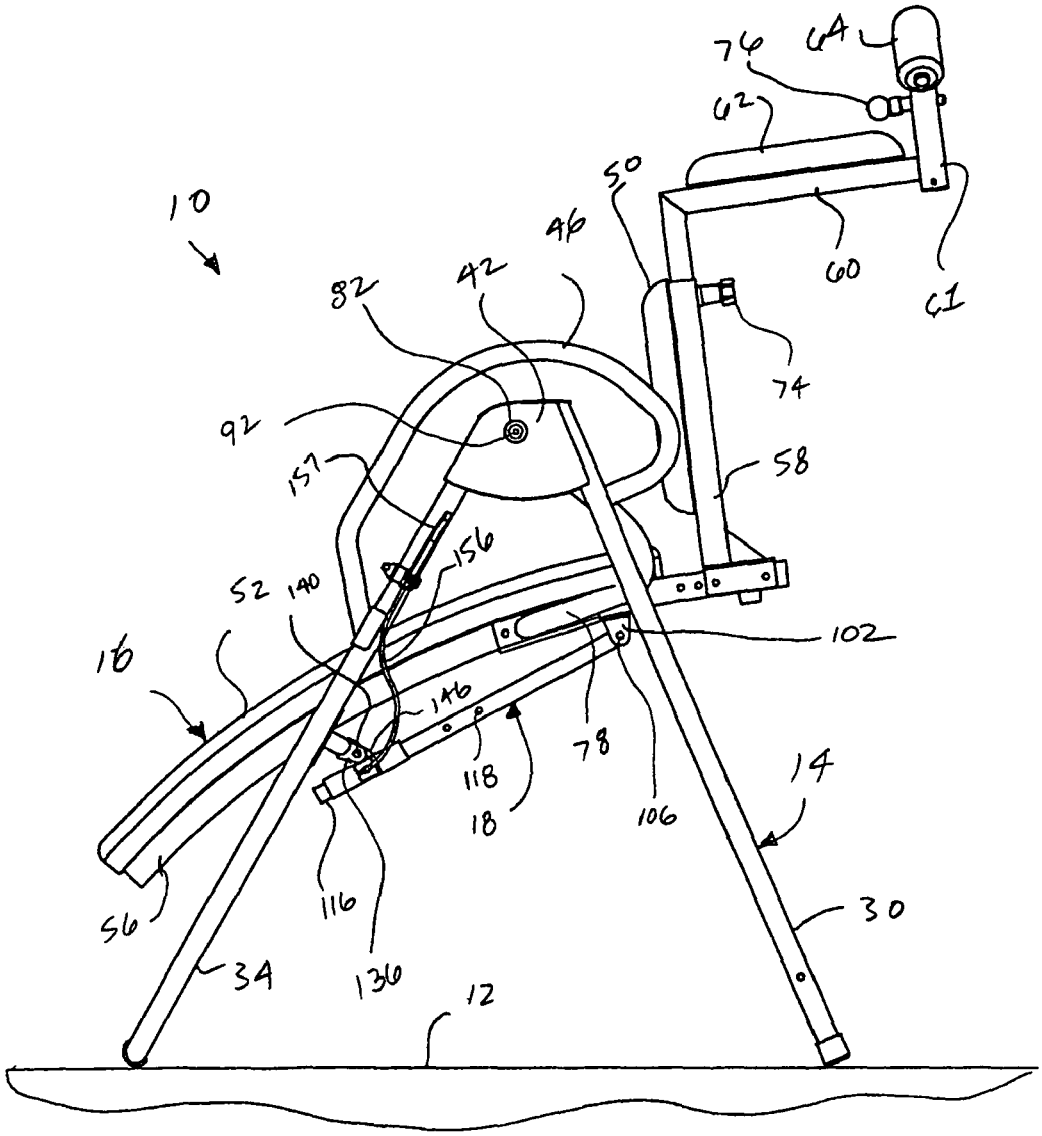
FIG. 7 is an enlarged view of FIG. 5.

As best seen in FIGS. 6 and 7, the second connector 20 has a pivot portion 146 with an opening for positioning within the bracket 136 in a manner substantially similar to that disclosed above with respect to bracket 102 and its coupling with the first connector 18. The pivot portion 146 corresponds in shape to fit within the bracket 136 so that the fastener 140 may be inserted within an opening 138 in bracket 136, within the opening in the pivot portion, and within the other opening 138 in the bracket 136, and pivotably secure the pivot portion 146 to the bracket 136. The pivot portion 146 may include a rounded surface or be otherwise configured to facilitate pivoting of the second connector 20 around the fastener 140, which acts as a pivot pin for the connector 20 relative to its connection with the cross brace 130. Of course, if desired, appropriate friction reducing elements, such as bearings 145 may be inserted into the opening in pivot portion 146 to control the level of friction between the various elements as the second connector 20 pivots with respect to the cross brace 130. The second connector 20 may receive the connecting end 116 of the first connector 18 as second connector 20 pivots with respect to the back brace 56 and as the second connector 20 pivots with respect to the frame 14. Friction reducing elements, such as a sleeve 117 may be employed between the connecting end 116 and the second connector 20 to control friction. As seen in the drawings, the second connector 20 may be positioned between the ends of the cross brace 130, beneath the seat 50 and the back 52 of the support 16. Thus, both the connectors 18 and 20 are positioned beneath the support 16 and in structural alignment with the portions of the brace 54.

Figure 8:
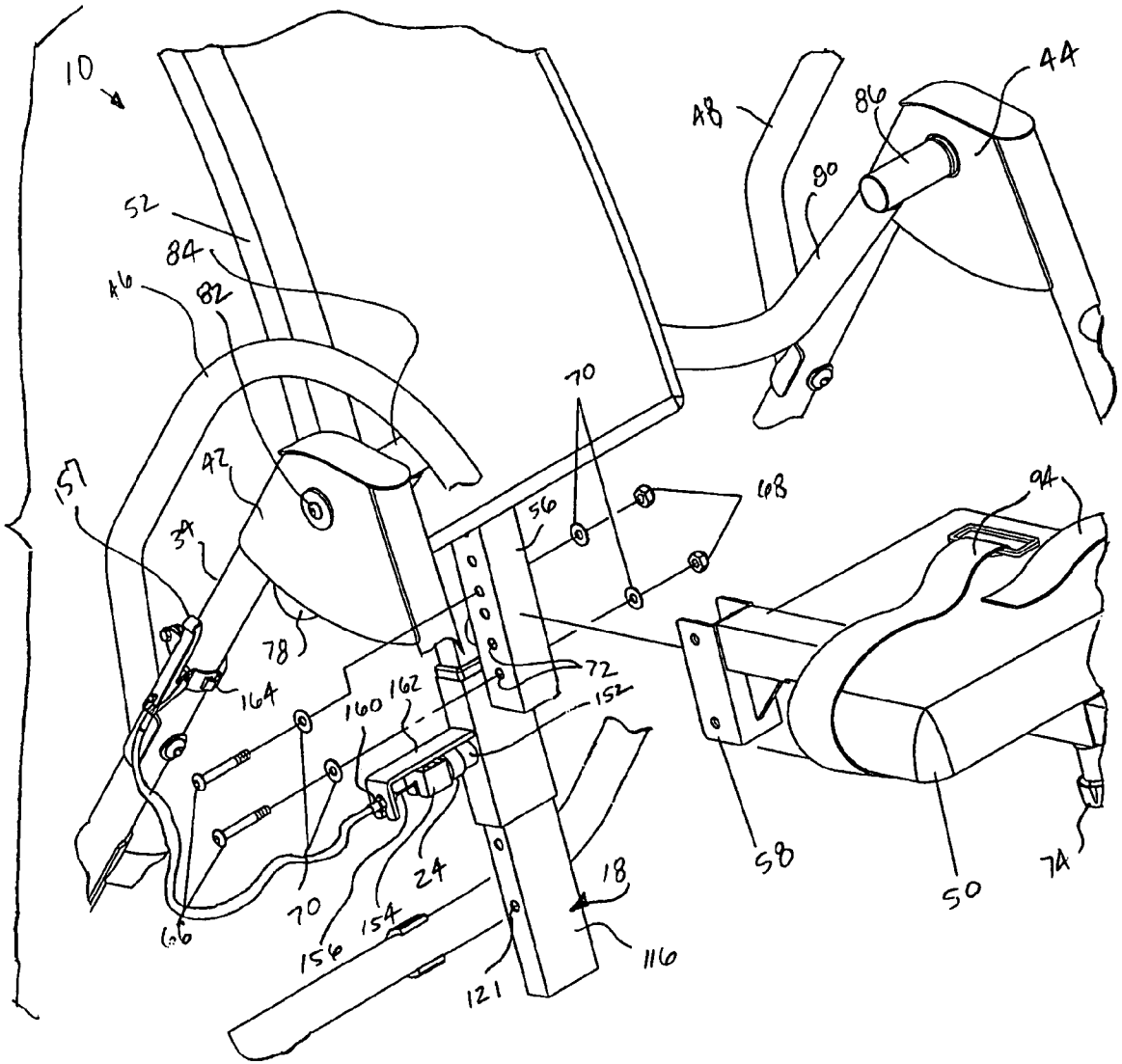
FIG. 8 is a partial, exploded view of the chair of FIG. 1.
Figure 12:
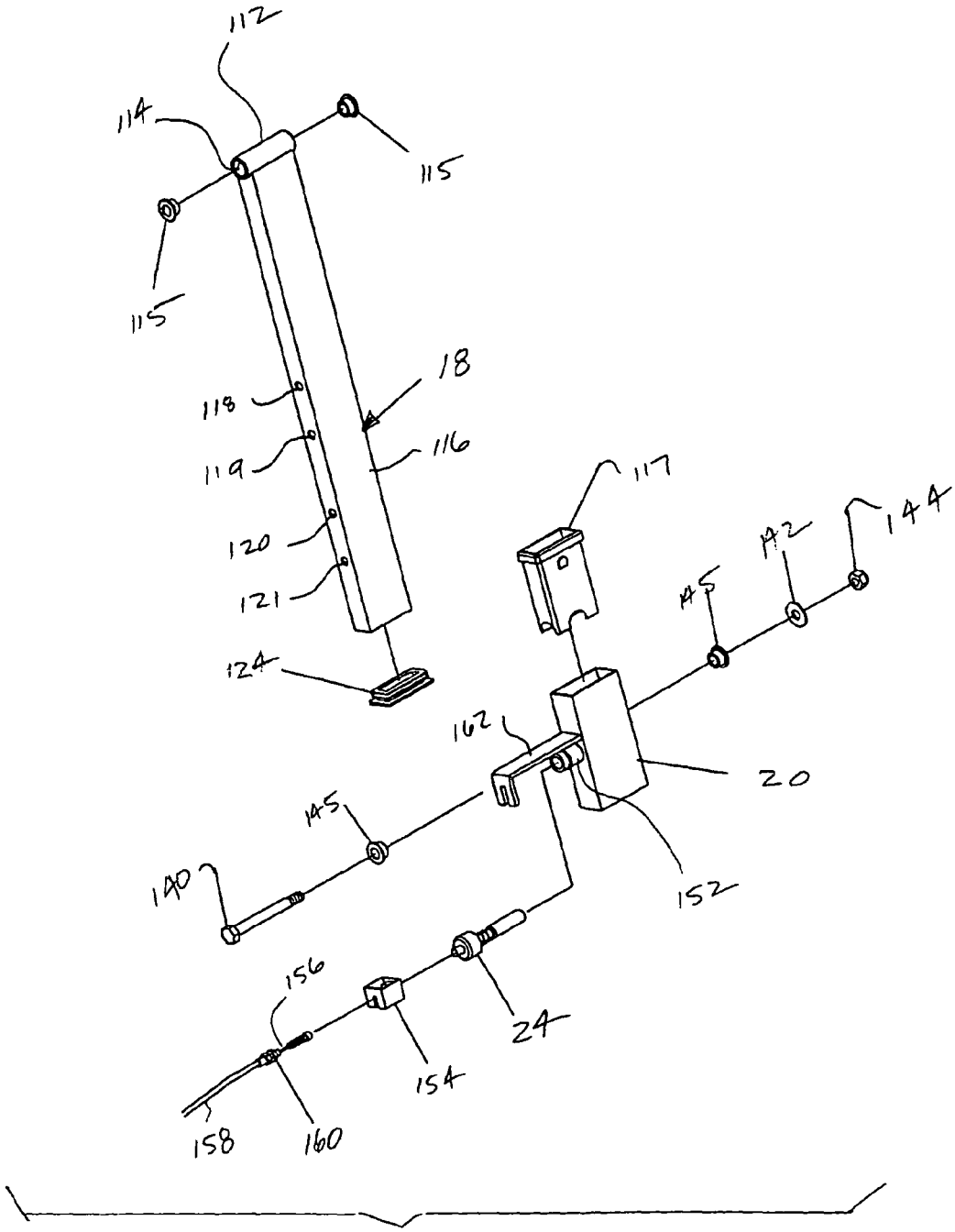
FIG. 12 is a partial, exploded view of the chair of FIG. 1.

The selective interlocking between the connectors 18 and 20 is accomplished, in part, in the illustrated embodiment of connector 20 through the use of a fastener 24 in the form of a locking spring pin that is positioned within a hole in the connector 20. As best seen in FIGS. 8 and 12, the spring-loaded pin 24 is inserted through a cylindrical supporter 152 fastened to the connector 20. A connecting block 154 is positioned at the opposite end of the spring pin 24, which is coupled to the controller 22. The controller includes a cable 156 activated by a lever 157. The cable 156 may be a wire cable and include a sheath 158 and a coupler 160, which is fastened to a cable supporter 162 attached to the second connector 20. As seen in the figures, the cable supporter 162 is shown as an extender that is rigidly secured to the second connector 20 to provide a rigid connection with the coupler 160 of the cable 156 and maintain the coupler 160 at a predetermined spacing from the spring pin 24 while the cable 156 is connected to the spring pin 24. The second connector 20 is shown as being formed as completely hollow so that the first connector 18 may extend completely through the second connector 20. The opposite end of the cable 156 is connected to the lever 157, which is secured to the frame 14 so that it is readily accessible by the user.

Figure 10:
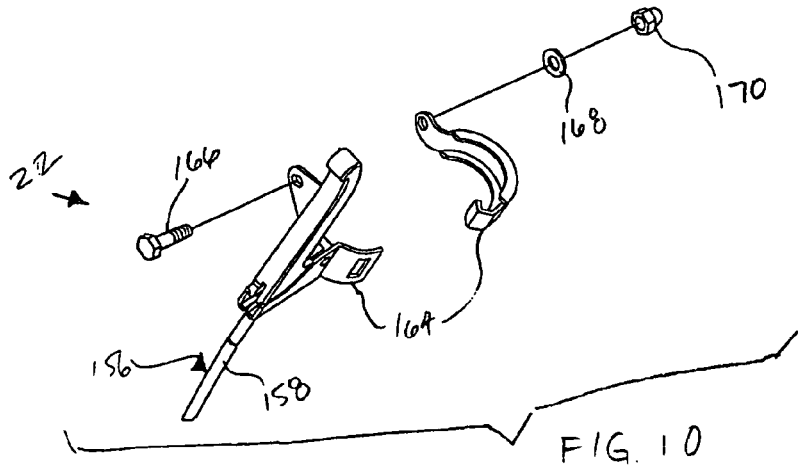
FIG. 10 is a partial, exploded view of the lever shown in FIG. 1.

As best seen in FIGS. 8 and 10, the lever 157 is of the hand-actuating type and is secured by a clamp 164 to the rear leg 34 using a fastener such as a bolt 166 with a washer 168 and a nut 170. The lever 157 is configured so that when the lever 157 is pulled with sufficient force to overcome the spring force applied by the spring pin 24, the cable 156 is pulled in a direction that is away from the spring pin 24, which, in turn, pulls the spring pin 24 away from the connector 18 and, ultimately, out of the engagement with the connector 18, i.e., the spring pin 24 is pulled out of the hole 118-121 in which it was engaged. Then, when the support 16 is positioned as desired relative to the frame 14, the lever 157 is released by the user or another. This releases the cable 156 and the spring pin 24 and permits the force of the spring in the spring pin 24 to move the spring pin into the connector 20 and into a hole 118-121 in connector 18 that is aligned with the spring pin 24 and that corresponds to the desired position of the support 16. Of course other variations are possible, including an automated mechanism that moves the support 16 after receiving the appropriate command.

FIGS. 1-5 best illustrate the movements of the assembly 10 during use. In FIG. 1, the assembly 10 is in the upright position, the first connector 18 is positioned within the second connector 20, and the spring pin 24 may be inserted within one of the holes 118-121 that may be positioned on the connector 20 to correspond to the support 16 being located in the upright position. Thus, the assembly 10 may be locked in to the upright position by the connectors 18 and 20. Alternatively, the support 16 may be able to move freely in the upright position. In the upright position, the user is able to sit on the support 14 much like a typical chair, by sitting on the seat 50 and leaning against the back 52. Then, the user's ankles are positioned between the foot portion 64 and the leg portion 62. A seat belt 94 may be employed to secure the user against the seat 50. When the user or another moves the lever 157 to disengage the spring pin 24 from the engaged hole 118-121, the support 16 is then free to pivot about the pivot axis 92, which corresponds to the longitudinal axis of the pivot arm ends 84 and 86 of the support 16. The user may grasp one or both handrails 46, 48 and move him or herself, along with the support 16, relative to the frame 14 to a desired, inclined position, relative to the upright position (i.e., counter clockwise or clockwise, when viewing FIGS. 2-5). Alternatively, another person or an automated device may move the user and the support 16 to the desired position. As the position of the user and the support 16 changes with respect to the frame 14, the first connector 18 moves relative to the second connector 20 by sliding further inward to or outward from the connector 20, depending on the direction the support 16 is pivoted relative to the frame 14. Since the spring pin 24 is biased by its spring toward the connector 18, the spring pin 24 may be adapted to automatically engage the next or adjacent hole 118-121 that is encountered by the spring pin 24 as the support 16 moves relative to the frame 14. Alternatively, the lever 157 may be engaged (e.g., held down by the user or another) so that the spring pin 24 remains disengaged from the first connector 18 so that the first connector 18 may move freely within the second connector 20 until the desired position or inclination of the support 16 is reached. In other words, the lever 157 may be activated (e.g., by the user or another holding the lever 157) until the support 16 is moved into the desired position/inclination relative to the frame 14. When that desired position/inclination is achieved, the lever 157 may be released to permit the spring pin 24 to engage an aligned hole 118-121 in the first connector 18. Also, if, after the releasing of the lever 157, the spring pin 24 does not engage a hole 118-121 since the pin 24 is not aligned with a hole 118-121, the releasing of the lever will permit the spring of the spring pin 24 to force the pin against first connector 18. Then, the support 16 may be moved relative to the frame 14 (e.g., by the user or another) in either direction to locate the closest hole 118-121. Once that closest hole 118-121 is discovered, the spring pin 24 will automatically engage that closest hole 118-121 and lock the support 16 in the desired position/inclination relative to the frame. These processes may be repeated to move the support 16 and the user to the desired position and lock that position so that the user and the support 16 stay in the desired position. Of course, the support 16 may be moved relative to the frame 14 into a desired position regardless of whether a user is positioned on the support 16.

Figure 5:
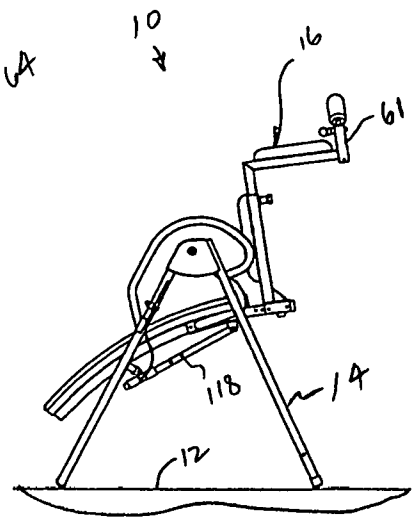
FIGS. 2-5 each illustrate a side elevational view of the chair of FIG. 1 with the seat in a different rotational position in each figure.
Figure 4:
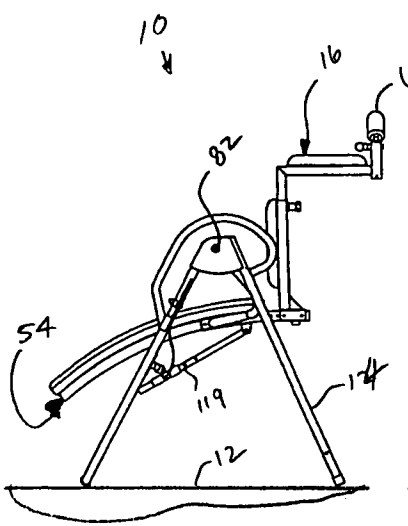
Figure 3:
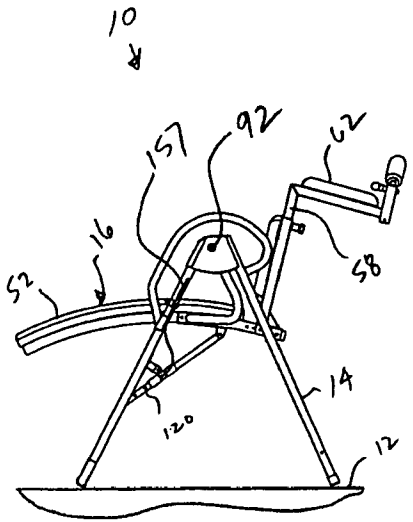
Figure 2:
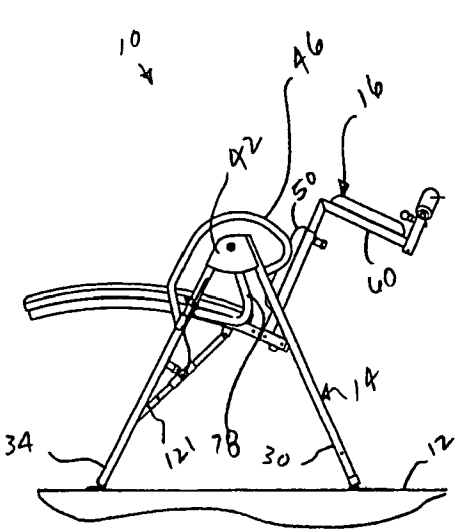

As seen in FIGS. 2-5, as the support 16 pivots counterclockwise around the pivot axis 92, the first connector 18 pivots relative to the back brace 56 and the second connector 20 pivots relative to the frame 14 and cross brace 130, while the first connector 18 moves relative to the second connector 20. As seen in FIGS. 2-5, as the support 16 moves from the position of FIG. 2 to the position of FIG. 5, the first connector 18 is being moved in a direction that moves first connector 18 as though it is being withdrawn from the second connector 20. FIGS. 2-5 also illustrate the illustrated position of the support 16 relative to the frame 14 for each of the illustrated four holes 118-121 in the first connector 18. That is, FIG. 2 shows the position of the support 16 when the spring pin 24 engages the first hole 118, while FIG. 3 shows the position when hole 119 is engaged, FIG. 4 shows the position when hole 119 is engaged, and FIG. 5 shows the position when hole 121 is engaged. It should be understood that the assembly 10 may be configured to accommodate any rotation of the support 16 relative to the frame 14 that is desired, and not only between those positions illustrated in FIGS. 2-5.

When it is desired to return the assembly 10 to the upright position, the same processes are employed, except that the ultimate position of the assembly 10 is the upright position shown in FIG. 1. The assembly 10 may be locked again in the upright position if desired so that the user can easily get out of or be removed from the assembly 10. Of course, positions other than the upright position may be used for the entry or exit of a user.

The foregoing embodiments have been provided to illustrate the structural and functional principles of the present invention, and are not intended to be limiting. To the contrary, the present invention is intended to encompass all modifications, alterations, and substitutions within the scope of the appended claims.

What is claimed is:

1. An assembly for supporting a user in different rotational positions relative to a surface, said assembly comprising:

a frame positioned on the surface;

a support being pivotably coupled to said frame, wherein said support comprises a back portion, a leg portion, and a separate seat portion arranged between said back portion and said leg portion, wherein a pivot axis about which the support pivots with respect to the frame is located above and spaced from an upper surface of each of the back portion and the separate seat portion in at least one of said different rotational positions, wherein said separate seat portion is arranged separated from and at a fixed angle with respect to said back portion;

a first connector extending from beneath said support and being movable with said support as said support moves relative to said frame; and a second connector positioned beneath said support, said first connector being movable relative to said second connector as said support moves relative to said frame, said first connector being selectively secured to said second connector in multiple positions, each of said multiple positions corresponding to a different rotational position of said support relative to said frame, wherein one or more of said different rotational positions is configured to support said user in an inverted position in which said leg portion is higher than the back portion above the surface.

2. An assembly according to claim 1, wherein said support includes pivot members extending from said support and connected to said frame.

3. An assembly according to claim 1, wherein one of said first and second connectors is a male connector and the other of said first and second connectors is a female connector.

4. An assembly according to claim 1, wherein said first connector is pivotably secured to said support.

5. An assembly according to claim 1, wherein said second connector is pivotably secured to said frame.

6. An assembly according to claim 1, wherein one of said first and second connectors includes apertures, and the other of said first and second connectors includes a fastener for selective insertion into one of said apertures.

7. An assembly according to claim 1, further comprising:

a controller comprising a cable and coupled to said second connector to selectively release one of said first and second connectors from the other of said first and second connectors so as to permit rotational movement of the support relative to the frame .

8. An assembly according to claim 7, wherein said controller is a lever connected to the cable and that controls the positioning of a fastener coupled between said first and second connectors.

9. An assembly according to claim 7, wherein said controller is secured to said frame.

10. The assembly of claim 1, wherein said support further comprises a foot portion separated from said back portion by said leg portion.

11. The assembly of claim 10, wherein said foot portion comprises a roller configured to contact an ankle of the user.

12. The assembly of claim 1, wherein said separate seat portion is arranged essentially perpendicular to each of said back portion and said leg portion.

13. The assembly of claim 1, further comprising a pair of stationary handrails adapted for hand gripping by the user, wherein each of the stationary handrails are attached at least at an end portion thereof to an associated fixed location on the frame.

14. The assembly of claim 1, further comprising a safety strap attached to the support and configured to adjustably secure the user's body to the support.

15. An assembly for supporting a user in different rotational positions relative to a surface, said assembly comprising:

a frame positioned on the surface;

a support being pivotably coupled to said frame, wherein said support comprises a back portion, a foot portion, and a separate seat portion arranged separate from the back portion and at a fixed angle with respect to said back portion;

a first connector extending from beneath said support and being movable with said support as said support rotates relative to said frame;

a second connector extending from said frame and positioned beneath said support, said first connector being movable relative to said second connector as said support moves relative to said frame, said first connector being selectively secured to said second connector in multiple positions, each of said multiple positions corresponding to a different rotational position of said support relative to said frame; and a controller comprising a cable that moves a fastener, which is coupled between said first and second connectors, between a locked position that prohibits movement between said first and second connectors and between said support and said frame, and an unlocked position that permits movement between said first and second connectors and between said support and said frame, wherein said permitted movement between said first and second connectors and between said support and said frame includes rotational movement into an inverted position in which the foot portion is raised at least as high above the surface as the back portion, wherein the rotational movement between said support and said frame is about a pivot axis located above and spaced from an upper surface of each of the back portion and the separate seat portion in at least one of said different rotational positions.

16. An assembly according to claim 15, wherein said back portion is arranged essentially parallel to a leg portion of the support located between said separate seat portion and said foot portion.

17. An assembly according to claim 15, wherein one of said first and second connectors is a male connector and the other of said first and second connectors is a female connector.

18. An assembly according to claim 15, wherein said first connector is pivotably secured to said support, and said second connector is pivotably secured to said frame.

19. An assembly according to claim 15, wherein one of said first and second connectors includes apertures, and the other of said first and second connectors includes said fastener for selective insertion into one of said apertures.

20. An assembly according to claim 15, wherein said controller is a lever connected to the cable.

21. An assembly according to claim 15, wherein said controller is secured to one side of said frame.

22. The assembly of claim 15, further comprising a leg portion arranged between said back portion and said foot portion.

23. The assembly of claim 22, wherein said permitted movement into the inverted position comprises the leg portion being raised higher above the surface than the back portion.

24. The assembly of claim 22, wherein said leg portion is arranged essentially parallel to said back portion.

25. The assembly of claim 24, wherein the separate seat portion is arranged between and essentially perpendicular to each of said back portion and said leg portion.

26. The assembly of claim 15, further comprising a pair of stationary handrails adapted for hand gripping by the user, wherein each of the stationary handrails are attached at least at an end portion thereof to an associated fixed location on the frame.

27. The assembly of claim 15, further comprising a safety strap attached to the support and configured to adjustably secure the user's body to the support.

28. An assembly for supporting a user in different positions relative to a surface, said assembly comprising:

a frame positioned on the surface;

a support pivotably coupled to said frame, said support comprising a convexly curved back portion configured to receive a user's back thereon and a separate seat portion, wherein said separate seat portion is arranged so as to be separated from and fixed at a generally perpendicular angle with respect to said back portion, wherein a pivot axis about which the support pivots with respect to the frame is located above and spaced from an upper surface of each of the convexly curved back portion and the separate seat portion in at least one of said different positions; and a position selection mechanism, said position selection mechanism being configured to allow pivotal movement of the support relative to said frame when said support is in an unsecured position, said position selection mechanism being configured to be actuated via a cable so as to selectively secure said support in one of a plurality of fixed positions with respect to said frame, wherein one or more of said plurality of fixed positions comprises an inverted position in which said back portion is pivoted at an angle below a horizontal reference plane parallel to said surface such that a user's head is placed closer to the surface than said user's back.

29. The assembly of claim 28, wherein said support comprises a leg portion.

30. The assembly of claim 28 wherein said support comprises a foot portion.

31. The assembly of claim 28, wherein said position selection mechanism comprises a plurality of apertures each configured to receive a fastener therein, each of said plurality of apertures being associated with one of the plurality of fixed positions.

32. The assembly of claim 31, further comprising a lever mechanism coupled to said fastener via the cable and attached to said frame, said lever mechanism being configured to either allow the user to selectively secure the support to the frame in one of the fixed positions or to release the frame into the unsecured position.

33. An assembly for supporting a user in different positions relative to a support surface, said assembly comprising:

a frame configured to be positioned on the support surface so as to have at least two portions thereof arranged to contact the support surface;

a support pivotably coupled to said frame, wherein said support comprises: (i) a convex-curved back surface portion configured to receive a user's back, (ii) a cushioned foot receiving portion configured to provide contact with a top portion of each of the user's feet, and (iii) a seat portion separate from the back portion and arranged between the back portion and the foot receiving portion, wherein a pivot axis about which the support pivots with respect to the frame is located above and spaced from an upper surface of each of the convex-curved back surface portion and the seat portion in at least one of said different positions;

a pair of stationary handrails adapted for hand gripping by the user, wherein each of the stationary handrails are attached at least at an end portion thereof to an associated fixed location on the frame; and a safety strap attached to the support and configured to adjustably secure the user's body to the support, wherein one or more of said different positions supports the user in an inverted position in which said foot receiving portion is higher than the convex-curved back portion relative to the support surface wherein the stationary handrails have a curvature that starts at the associated fixed location on a front portion of the frame and which: (1) initially curves forward towards a front portion of the seat portion defined when the assembly is in a starting position; then (2) upward in a direction opposite the support surface; and then (3) both downward toward the support surface and rearward toward a rear portion of the frame.

34. The assembly of claim 33, wherein the frame is configured to have three portions thereof in contact with the support surface.

35. The assembly of claim 33, further comprising an adjustable foot brace arranged adjacent to the cushioned foot receiving portions.

36. The assembly of claim 33, wherein the cushioned foot receiving portions each comprise a contoured section configured to contact tops of the user's feet in front of the user's ankles.

37. The assembly of claim 33, wherein the stationary handrails are each connected to an associated fixed position on the rear portion of the frame.

38. The assembly of claim 33, wherein the separate seat portion is operatively coupled between the convex-curved back portion and the cushioned foot receiving portion so as to move in conjunction with a movement of the convex-curved back portion.

39. The assembly of claim 38, wherein the separate seat portion is arranged in a fixed relationship with respect to the convex-curved back portion.

40. The assembly of claim 38, wherein the safety strap is attached to the separate seat portion.

41. The assembly of claim 33, further comprising a leg supporting structure coupled to the support and configured to contact with and support back portions of the user's legs.

* * * * *